US008578897B2

(12) United States Patent
Fabros

(10) Patent No.: US 8,578,897 B2
(45) Date of Patent: Nov. 12, 2013

(54) VALVE SYSTEM

(75) Inventor: Charles Fabros, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 117 days.

(21) Appl. No.: 13/084,723

(22) Filed: Apr. 12, 2011

(65) Prior Publication Data

US 2011/0265746 A1 Nov. 3, 2011

(51) Int. Cl.
*F01L 9/02* (2006.01)

(52) U.S. Cl.
USPC ..... 123/90.12; 123/90.48

(58) Field of Classification Search
USPC ..... 123/90.12, 90.16, 90.48, 90.55
See application file for complete search history.

(56) References Cited

U.S. PATENT DOCUMENTS

| | | | | |
|---|---|---|---|---|
| 2,570,853 | A | 10/1951 | Pierce | |
| 2,570,854 | A | 10/1951 | Pierce | |
| 3,380,440 | A | 4/1968 | Thuesen | |
| 3,490,423 | A | 1/1970 | Shunta et al. | |
| 4,688,525 | A | 8/1987 | Nakamura | |
| 5,113,811 | A * | 5/1992 | Rembold et al. | 123/90.12 |
| 5,372,114 | A | 12/1994 | Gant et al. | |
| 5,499,606 | A * | 3/1996 | Robnett et al. | 123/90.12 |
| 5,503,120 | A * | 4/1996 | Shirey et al. | 123/90.12 |
| 6,382,147 | B1 | 5/2002 | Plohberger | |
| 6,675,751 | B1 | 1/2004 | Megli et al. | |
| 6,681,730 | B1 | 1/2004 | Koneda et al. | |
| 6,736,092 | B2 * | 5/2004 | Borean et al. | 123/90.12 |
| 7,793,627 | B2 * | 9/2010 | Bang | 123/90.16 |
| 2002/0104495 | A1 | 8/2002 | Niethammer et al. | |

FOREIGN PATENT DOCUMENTS

| | | | |
|---|---|---|---|
| JP | 54049412 | A | 4/1979 |

* cited by examiner

*Primary Examiner* — Thomas Denion
*Assistant Examiner* — Daniel Bernstein
(74) *Attorney, Agent, or Firm* — Julia Voutyras; Alleman Hall McCoy Russell & Tuttle LLP

(57) ABSTRACT

A valve system for providing closing force to one or more valves of an engine is provided. In one example, the system comprises a first tappet bore in fluid communication with a second tappet bore via a bidirectional oil passage. The system may provide valve closing forces to assist in the closing of valves coupled to the tappet bores, lowering required valve spring forces.

18 Claims, 9 Drawing Sheets

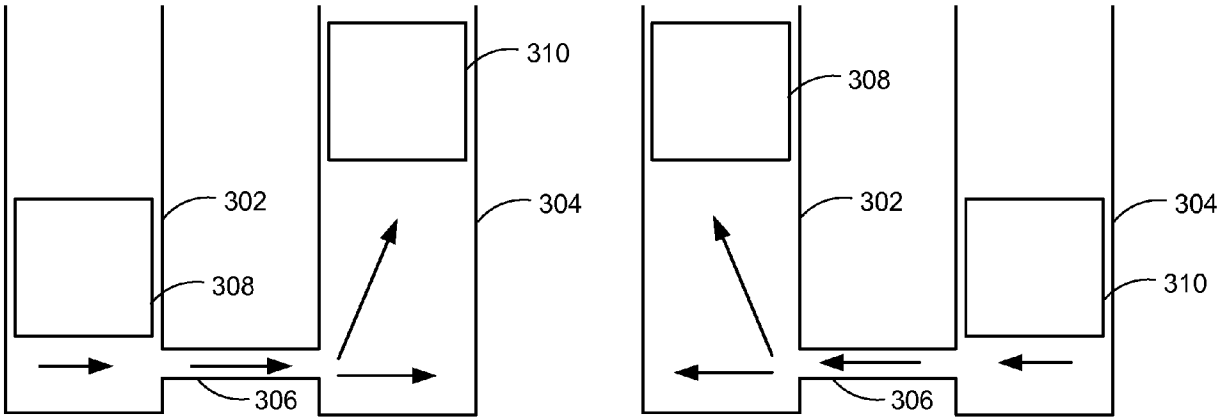
FIG. 3A
FIG. 3B
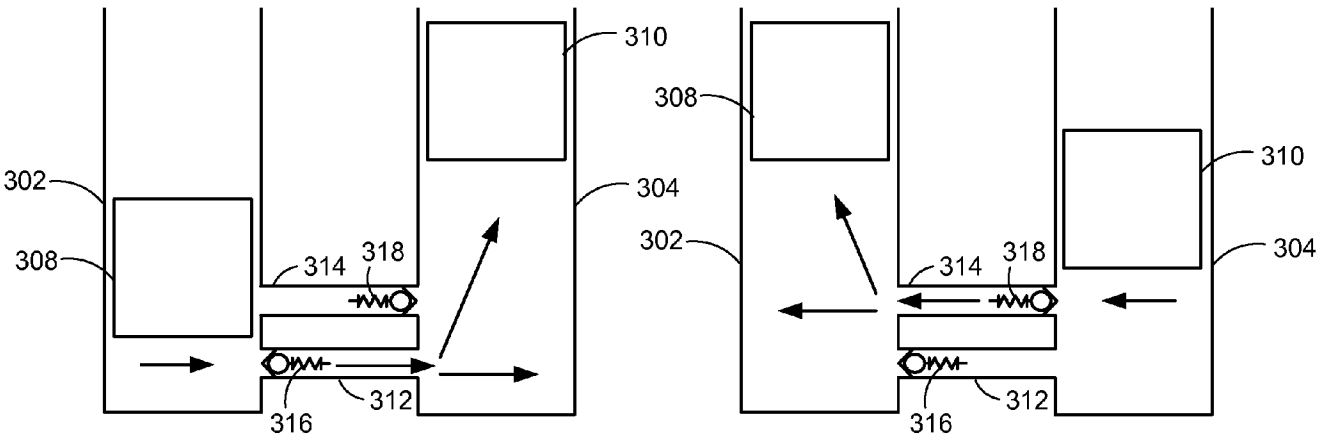
FIG. 3C
FIG. 3D

VALVE SYSTEM

FIELD

The present description relates to controlling valve opening and closing.

BACKGROUND AND SUMMARY

Cylinder intake and exhaust events of internal combustion engines may be controlled via poppet valves positioned within the intake and exhaust ports of a cylinder. These poppet valves can be opened by mechanical force provided by cam lobes of a camshaft. The valves close when the valves, or extensions from the valves (e.g., a tappet), encounter a base circle portion of the camshaft. A valve may close due to spring force from a valve spring coupled to the valve stem. Hydraulic dampening mechanisms are often present to reduce noise and wear to the valvetrain components due to higher valve closing forces. Such dampening mechanisms can include an oil-filled chamber housing the valve stem to provide pressure against the closing force of the valve and to softly seat the valve.

The inventor herein has recognized a number of issues with the above approach. The required static spring forces may be greater than the minimum force to close the valve since spring oscillations and pressure forces due to cylinder head port pressures may reduce the force applied to close the valve. As a result, the valve may remain open when it is intended to be closed. Increasing spring forces to counteract cylinder port pressures can lead to additional problems, however. In engines which require high RPM capability, the spring forces may be selected higher to control the dynamic forces which increase with the square of the angular velocity. These higher spring forces may cause increased and unnecessary driving torques during normal, lower RPM operating range. As a result, fuel economy and component durability may be compromised. Additionally, for engines which require higher port pressures in either the inlet or exhaust port due to forced induction, the spring forces may be higher yet so as to counteract the higher port pressures and close the valve. Higher spring forces can cause increased and unnecessary driving torques in the low load, low pressure region of the engine operating range. Thus, engine efficiency benefits provided via engine boosting may be offset by some extent when higher spring forces are applied to close poppet valves.

In one example, the above issues may be at least partially addressed by a valve system for an engine, comprising a first tappet bore of a first cylinder and a second tappet bore of a second cylinder, and a bidirectional oil passage in fluid communication with the first tappet bore and the second tappet bore.

In this manner, oil may flow within the bidirectional oil passage between the first and second tappet bores to provide additional closing force to valves in the tappet bores. For example, the first and second cylinders may be a multiple of 180 crankshaft degrees apart in a firing order of the engine. As a result, as a first valve within the first tappet bore opens, a second valve within the second tappet bore closes. Oil may flow through the bidirectional oil passage from the first tappet bore as the first valve opens, to the second tappet bore. The increased oil in the second tappet bore may provide a closing force to close the second valve. The present disclosure may provide several advantages. Specifically, by providing additional closing force via a bidirectional oil passage, the spring forces required for valve closing may be lowered, thereby improving fuel economy and component durability in certain engine operating conditions. Additionally, the oil in the tappet bores may provide a dampening mechanism to softly seat the closing valve and improve component durability. Further, since oil pressure force within the tappet increases with engine speed, higher valve closing forces may be provided at higher engine speeds when higher valve closing forces may be desirable.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3A-D illustrate example valve closing forces for two valves of the engine.

DETAILED DESCRIPTION

Figure 1:
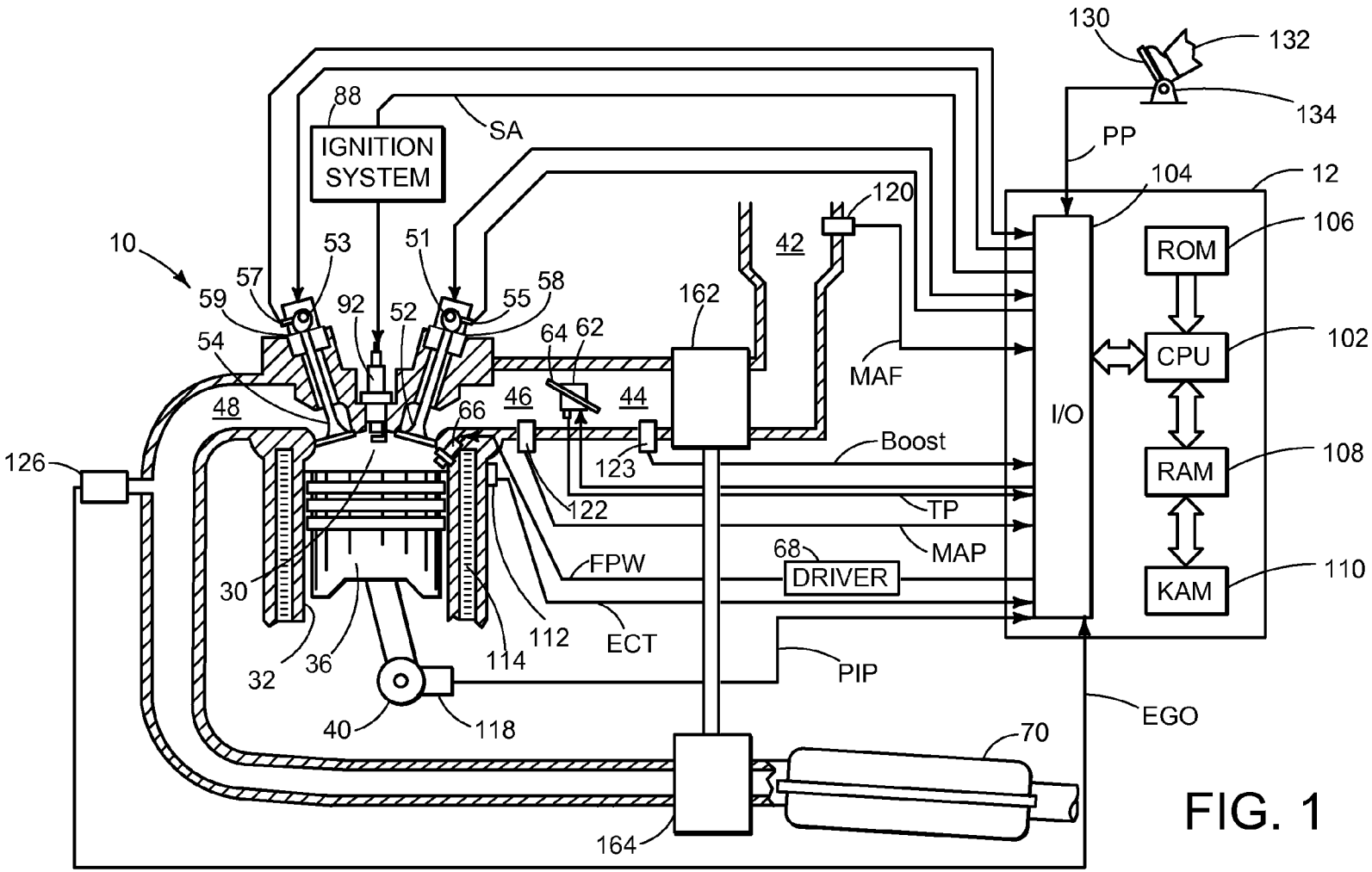
FIG. 1 is a schematic diagram of an engine.

The present description relates to systems and methods for operating a valve system of an internal combustion engine. In one non-limiting example, the engine may be configured as illustrated in FIG. 1. Further, various examples of the valve system as illustrated in FIGS. 2A-B and 5-8 may be part of the engine of FIG. 1.

Figure 4:
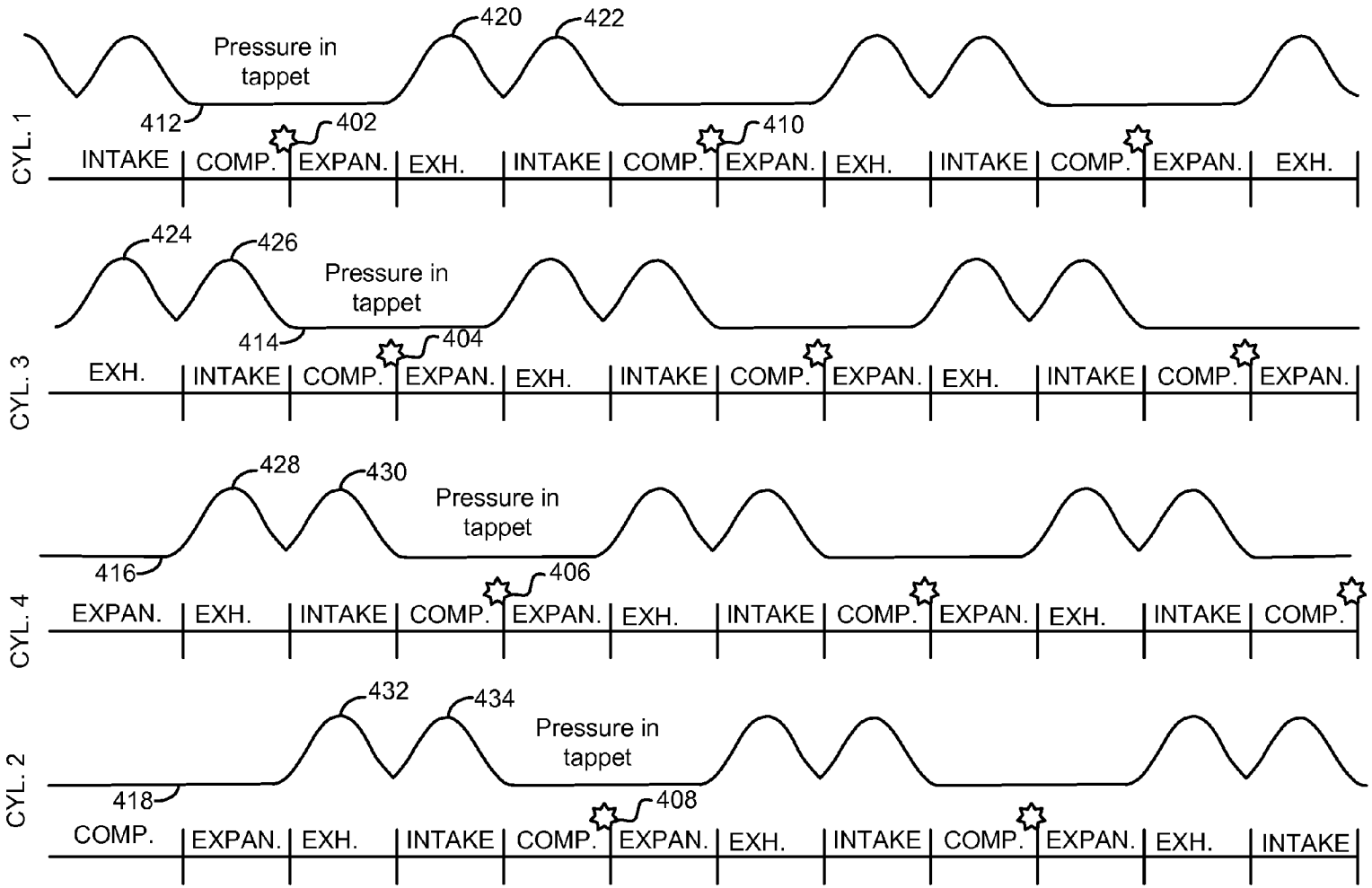
FIG. 4 is an example plot of signals of interest during operation of a four cylinder engine.
Figure 9:
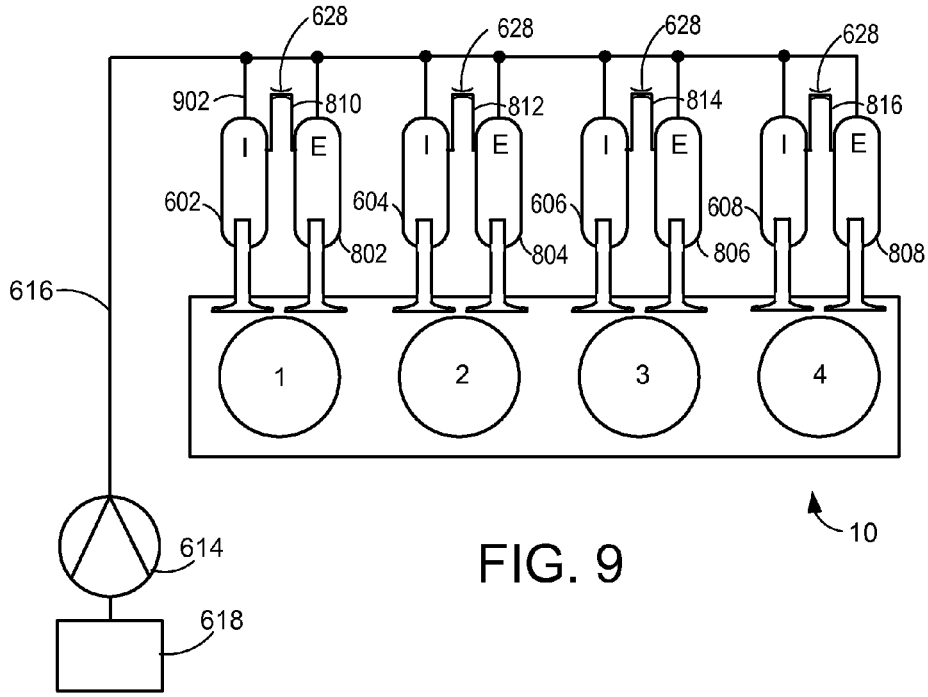

Valve closing forces may be provided according to the system depicted in FIGS. 3A-B and the method illustrated in FIG. 9, which shows an example method for providing valve closing force. FIG. 4 illustrates signals of interest during engine operation according the method of FIG. 9.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e. cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 46 via intake passage 42 and may exhaust combustion gases via exhaust passage 48. Intake manifold 46 and exhaust passage 48 can selectively communicate with combustion chamber 30 via respective intake valve 52 and exhaust valve 54. In some examples, combustion chamber 30 may include two or more intake valves and/or two or more exhaust valves.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 46, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

In this example, intake valve 52 and exhaust valve 54 may be controlled by cam actuation via respective cam actuation systems 51 and 53, which may transfer force to intake and/or exhaust valves via tappets 58 and 59. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative examples, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some examples, combustion chamber 30 may alternatively or additionally include a fuel injector arranged in intake manifold 46 in a configuration that provides what is known as port injection of fuel into the intake port upstream of combustion chamber 30.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold absolute pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some examples, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some examples, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Storage medium read-only memory 106 can be programmed with computer readable data representing instructions executable by processor 102 for performing the methods described below as well as other variants that are anticipated but not specifically listed. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and manifold absolute pressure signal (MAP) from sensor 122. Engine speed signal (RPM) may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During some conditions, the MAP sensor can give an indication of engine torque. Further, this sensor, along with the detected engine speed and other signals, can provide an estimate of charge (including air) inducted into the cylinder. In one example, sensor 118, which is also used as an engine speed sensor, may produce a predetermined number of equally spaced pulses every revolution of the crankshaft.

Engine 10 may further include a compression device such as a turbocharger or supercharger including at least a compressor 162 arranged along compressor passage 44, which may include a boost sensor 123 for measuring air pressure. For a turbocharger, compressor 162 may be at least partially driven by a turbine 164 (e.g. via a shaft) arranged along exhaust passage 48. For a supercharger, compressor 162 may be at least partially driven by the engine and/or an electric machine, and may not include a turbine. Thus, the amount of compression provided to one or more cylinders of the engine via a turbocharger or supercharger may be varied by controller 12.

Further, in the disclosed examples, an exhaust gas recirculation (EGR) system (not shown) may route a desired portion of exhaust gas from exhaust passage 48 to boost passage 44 and/or intake passage 42 via an EGR passage. The amount of EGR provided to boost passage 44 and/or intake passage 42 may be varied by controller 12 via an EGR valve. Further, an EGR sensor may be arranged within the EGR passage and may provide an indication of one or more pressure, temperature, and concentration of the exhaust gas. Under some conditions, the EGR system may be used to regulate the temperature of the air and fuel mixture within the combustion chamber, thus providing a method of controlling the timing of ignition during some combustion modes. Further, during some conditions, a portion of combustion gases may be retained or trapped in the combustion chamber by controlling exhaust valve timing.

As described above, FIG. 1 shows only one cylinder of a multi-cylinder engine, and each cylinder may similarly include its own set of intake/exhaust valves, fuel injector, spark plug, etc. However, some or all of the cylinders may share some components such as camshafts for controlling valve operation. In this manner, a camshaft may be used to control valve operation for two or more cylinders.

Figure 2B:
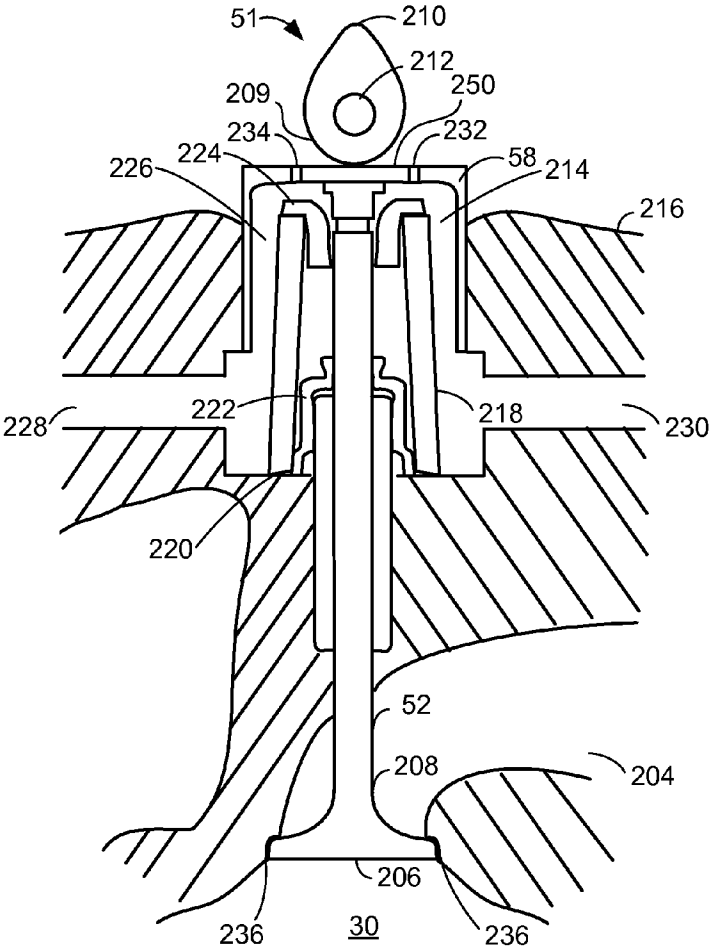
FIGS. 2A and 2B schematically show a valve system in various operating states according to one example of the disclosure.
Figure 2A:
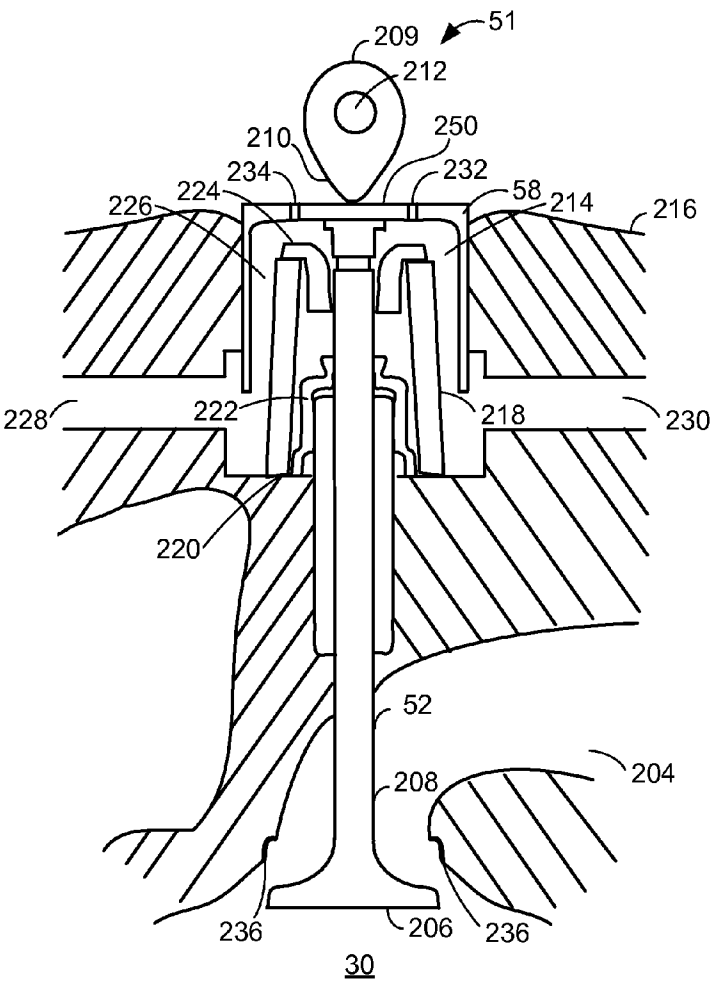

FIGS. 2A and 2B show an example valve system. Referring to FIG. 2A, an intake valve 52 controlling an intake or exhaust port 204 of a cylinder 30 of engine 10 is depicted in its open position. Intake valve 52 comprises a valve head 206 connected to a valve stem 208. Force to open intake valve 52 is provided via cam actuation system 51. In this example, cam actuation system 51 includes a cam lobe 210 rotating with a camshaft 212 situated overhead of cylinder 30. The valve opening force provided by the cam lobe 210 is transferred to the intake valve 52 via tappet 58. In this example, tappet 58 is a flat bucket tappet situated in a tappet bore 214 contained within cylinder head 216. However, other types of tappets, such as roller or hydraulic tappets, are also within the scope of this disclosure. Cam lobe 210 maintains contact with tappet 58 during a portion of the camshaft rotation while base circle 209 is in contact with tappet for the remainder of camshaft rotation. When the lobe portion contacts the tappet 58, it urges the tappet to a position where intake valve 52 is opened so as to allow gases to flow into the cylinder. In alternative examples where the valve is an exhaust valve, opening the exhaust valve allows gases to flow out of the cylinder.

Intake valve 52 is coupled to a valve spring system that provides force to close the valve. Valve spring system comprises a valve spring 218 coupled to spring seat 220, a valve seal 222, and spring retainer 224. Once the camshaft has rotated the cam lobe past the position providing maximum valve lift (e.g. the highest portion of the cam lobe), the force transferred from the cam to the tappet is reduced until the base circle is reached. The valve spring 218, which undergoes compression during valve opening, provides force to urge the valve 52 and tappet 58 to the closed position.

The bottom of tappet 58 (e.g. the side in communication with valve 52), and the bottom of tappet bore 214 comprise a reservoir 226 which may be filled with a hydraulic fluid such as oil. Passage 228 within cylinder head 216 may connect the tappet bore 214 to an oil pump (not shown) via an engine oil gallery to provide pressurized oil to the tappet bore. Additionally, a bidirectional oil passage 230 may further be coupled to the tappet bore. Oil passage 230 may be coupled to one or more tappets to provide additional closing force for other valves of engine 10, as will be described in more detail below. In order to regulate oil pressure in the tappet bore and vent air bubbles present in the oil, tappet may comprise bleed holes 232, 234 on face 250 of the tappet 58.

FIG. 2B shows the valve system of FIG. 2A in its closed position. Base circle 209 is contacting tappet 58, and as a result no downward force is being applied to move the tappet 58 or valve 52 to the open position. The valve head 206 is positioned against valve seat 236 which limits the valve to its closed position and, together with the valve head 206, provide a seal to prevent gases from flowing into or out of the combustion chamber of cylinder 30. Valve spring 218 is less compressed and, due to the position of cam lobe 210, tappet 58 is in its most elevated position. As a result, the volume of reservoir 226 is increased compared to the volume of the reservoir 226 shown in FIG. 2A, when the valve is in its open position.

FIGS. 3A-3D depict example systems for operating two valves of engine 10. In this example, engine 10 is an inline four cylinder engine with a firing order of 1-3-4-2. However, alternate engine arrangements are within the scope of this disclosure. In FIGS. 3A and 3B, two example tappet bores 302 and 304 are shown to be in fluid communication with each other via a bidirectional oil passage 306. The first tappet bore 302 may house an intake valve and the first tappet may be in hydraulic communication with a tappet of a cylinder that is a multiple of 90 crankshaft degrees apart from the cylinder to which a second intake valve housed within the second tappet bore 302 is coupled to. For example, for a V8 engine having a firing order of 1-3-7-2-6-5-4-8, a tappet of an intake valve of a cylinder number three may be in hydraulic communication with a tappet of an exhaust valve of cylinder number one. In this way, as the exhaust valve of cylinder number one closes, the intake valve of cylinder number three is opening and therefore helps to close the exhaust valve of cylinder number one. Therefore, the pressure generated in the tappet of the first cylinder is applied to the tappet of the second cylinder adding force to close the exhaust valve of the second cylinder. In alternative examples, one valve may be an intake valve and the other valve may be an exhaust valve. In other examples, one valve may be an exhaust valve and the other valve may also be an exhaust valve. In still other examples, two intake valve tappets of two different cylinders may be in hydraulic communication. In some engines, such as engines with four cylinders, the exhaust tappet of a cylinder may be in hydraulic communication with an intake tappet of the same cylinder. The overlap period between the intake and exhaust valve can allow force from the intake cam to be transferred to the exhaust valve tappet.

Boxes 308, 310 each represent a tappet and associated valve system, such as one depicted in FIGS. 2A and 2B. Referring to FIG. 3A, a camshaft (not shown) may provide force urging tappet and associated valve system 308 downward to an open valve position, as explained above with respect to FIGS. 2A and 2B, in order to open the valve, for example during the intake stroke. Oil within tappet bore 302 becomes pressurized and as a result may flow out of tappet bore 302 and into the bidirectional oil passage 306 coupled to the tappet bore, as indicated by the arrows. Oil may flow through the oil passage 306 to the second tappet bore 304, providing increasing pressure to the oil contained within tappet bore 304. As tappet bore 304 houses an intake valve coupled to a cylinder that is a multiple of 180 crankshaft degrees apart from the cylinder coupled to the valve system of tappet bore 302, if the first cylinder is in the intake stroke, the second cylinder will be in the expansion stroke. As a result, the camshaft is not providing valve opening or downward force on the tappet and associated valve system 310. The introduced oil pressure thus may provide closing force to urge the tappet and associated valve system 310 upwards.

Referring now to FIG. 3B, the first valve system 308 is depicted in the act of closing a valve, while the second valve system 310 is opening a valve. The camshaft provides force to open the valve system 310 of tappet bore 304. Consequently, the oil in tappet bore 304 becomes pressurized and flows out through the bidirectional oil passage 306 to tappet bore 302 as indicated by the arrows. This introduced oil pressure in tappet bore 302 may provide closing force to close the valve of tappet bore 302.

FIGS. 3C and 3D depict an alternative example system for operating valves. Here, when the camshaft urges tappet and associated valve system 308 downward, oil may flow through a unidirectional oil passage 312 coupled to tappet bore 304. In this way, tappet 310 is urged in a valve opening direction. A second unidirectional oil passage 314 is also provided for allowing oil flow in the opposite direction. Control of the oil flow may be provided via check valves 316, 318. Check valve 316 may be configured in oil passage 312 to allow oil flow from tappet bore 302 to tappet bore 304, and prevent oil flow from tappet bore 304 to tappet bore 302. Conversely, check valve 318 may be configured in oil passage 314 to allow oil flow from tappet bore 304 to tappet bore 302, and prevent oil flow from tappet bore 302 to tappet bore 304.

Referring to FIG. 4, an example plot of a simulated engine operation is shown. Time begins on the left side of the plot and increases to the right side of the plot. The illustrated sequence represents an operation of a non-limiting four cylinder four cycle engine. The illustrated sequence may occur at the beginning of engine operation, in the middle, or at the end. In this example, the vertical markers between cylinder position traces CYL. 1-4, represent top-dead-center or bottom-dead-center for the respective cylinder strokes, and there are 180 crankshaft degrees between each vertical marker.

Cylinders 1-4 each go through intake, compression, expansion, and exhaust strokes during a cycle of the cylinder, and the engine combustion order is 1-3-4-2. In the example of FIG. 4, the tappet of an intake valve is in hydraulic communication with an exhaust valve of the same cylinder. As a result, force may be transferred from the intake camshaft via the intake tappet to the exhaust valve via the exhaust tappet. The overlap period between the exhaust valve timing and the intake valve timing may provide such operation. In addition, in some examples, the phase of the intake valve and/or exhaust valve timing may be adjusted to increase the intake valve and exhaust valve overlap, thereby allowing additional force to be transferred from the intake camshaft to the closing exhaust valve.

The first plot from the top of the figure represents position of cylinder number one. And, in particular, the stroke of cylinder number one as the engine crankshaft is rotated. Each stroke may represent 180 crankshaft degrees. Therefore, for a four stroke engine, a cylinder cycle may be 720°, the same crankshaft interval for a complete cycle of the engine. The star at label 402 indicates the first ignition event for the first combustion event. Star 410 represents the second combustion event for cylinder number one and the fifth combustion in the operation of the illustrated sequence. The ignition may be initiated by a spark plug or by compression. In this sequence, cylinder number one valves are open for at least a portion of the intake stroke to provide air to the cylinder. Fuel may be injected to the engine cylinders by port or direct injectors. The fuel and air mixture is compressed and ignited during the compression stroke.

The second cylinder position trace from the top of the figure represents the position and stroke for cylinder number three. Since the combustion order of this particular engine is 1-3-4-2, the second combustion event from engine stop is initiated at 404 as indicated by the star. Star 404 represents the initiation of the first combustion event for cylinder number three and the second combustion event in the illustrated sequence.

The third cylinder position trace from the top of the figure represents the position and stroke for cylinder number four. Star 406 represents the initiation of the first combustion event for cylinder number four and the third combustion event.

The fourth cylinder position trace from the top of the figure represents the position and stroke for cylinder number two. Star 408 represents the initiation of the first combustion event for cylinder number two and the fourth combustion event.

Above each cylinder plot is a representation of example oil pressures in a tappet associated with that cylinder. For example, pressure plot 412 depicts the pressure in a tappet coupled to an intake valve of cylinder one. Pressure plot 414 depicts the pressure in a tappet coupled to an intake valve of cylinder three, pressure plot 416 depicts the pressure in a tappet coupled to an intake valve of cylinder four, and pressure plot 418 depicts the pressure in a tappet coupled to an intake valve of cylinder two.

Referring to the first cylinder trace, during the exhaust stroke, the exhaust valve opens, causing the oil reservoir volume within the exhaust valve tappet bore to decrease, as explained above with respect to FIG. 2A. As a result, oil pressure in the intake valve tappet bore increases, as shown by peak 420 of the pressure plot 412. After the exhaust valve passes maximum lift and begins to close, the pressure recedes back toward baseline pressure level 412. Since the intake valve of cylinder number one is closed during the period when the pressure provided via the exhaust camshaft to the exhaust tappet is at a peak value, there is no affect on the operation of the intake valve of cylinder number one.

During the intake stroke of cylinder number one, an intake valve of cylinder number one begins to open and pressure in the exhaust valve tappet of cylinder number one increases since the intake valve of cylinder number one is in hydraulic communication with the exhaust valve of cylinder number one. As a result, the intake camshaft assists the exhaust valve in closing. Oil from the intake valve tappet bore of cylinder one flows into the exhaust valve tappet bore of cylinder one via an oil passage such as a bidirectional oil passage, causing the pressure of the exhaust valve tappet bore of cylinder one to increase, as seen by peak 422 of pressure plot 412. Increasing pressure in the exhaust tappet of cylinder number one provides increased closing force to aid in the closing of the exhaust valve of cylinder number one. Once the intake valve of cylinder one has fully closed, the pressure in the tappet returns to baseline at 412. In this way, the intake camshaft provides closing force to cylinder number one exhaust valve via the intake valve and exhaust valve tappets.

Similar to cylinders one, cylinders two, three, and four have intake valve tappets in hydraulic communication with exhaust valve tappets. As explained with regard to cylinder number one, as the intake valves of cylinders number two, three, and four open, pressure in the exhaust valve tappet of the respective cylinders increases thereby assisting in the closing of exhaust valves for cylinder numbers two, three, and four. Pressure peaks 424-434 show similar pressure peaks for cylinder numbers two, three, and four in the intake and exhaust valve tappets as is shown for cylinder number one.

Figure 5:
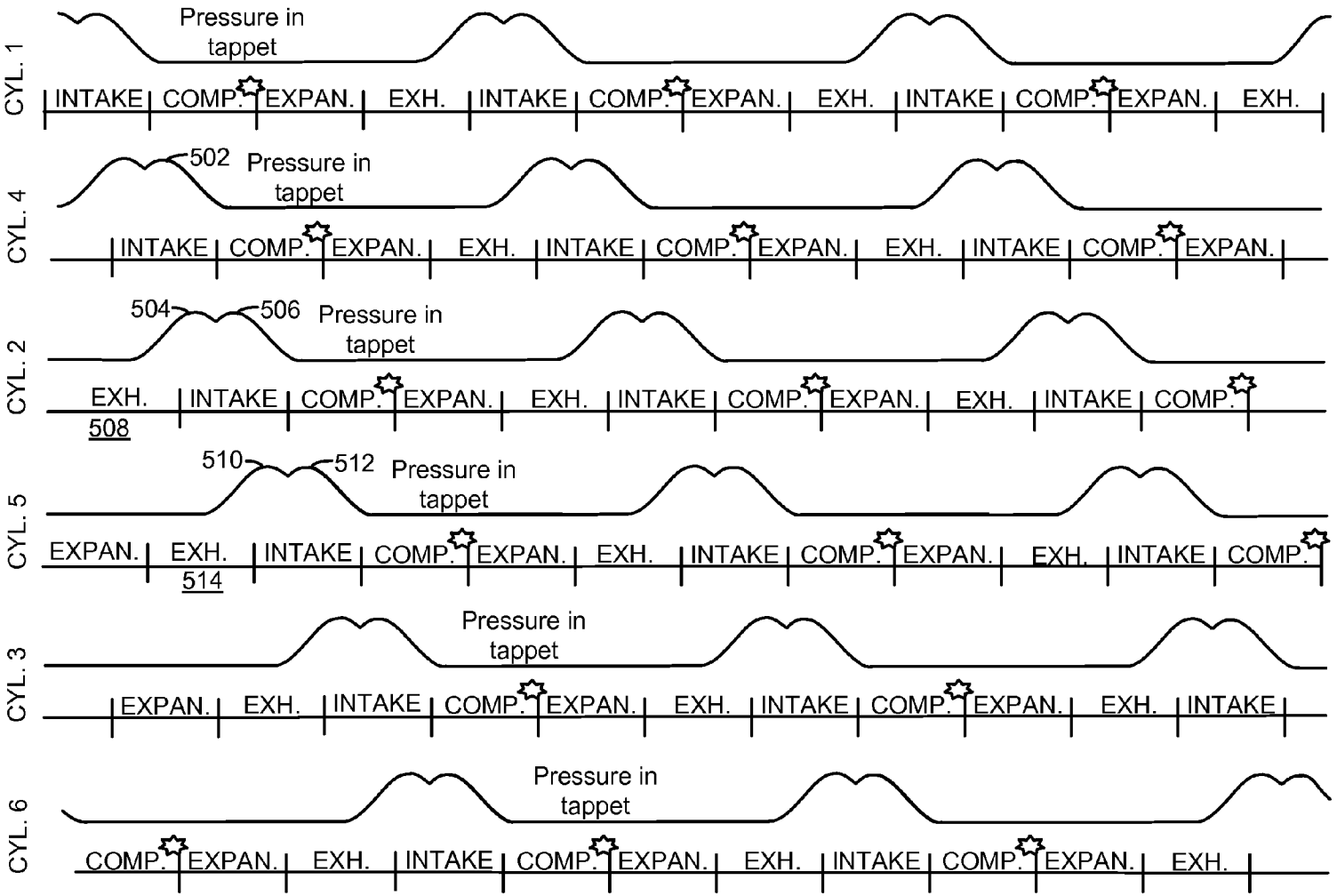
FIG. 5 is an example plot of signals of interest during operation of a six cylinder engine.

Referring now to FIG. 5, oil pressures in exhaust valve tappets and intake valve tappets for an example six cylinder engine are shown. The six cylinder engine has a firing order of 1-4-2-5-3-6. The sequence of FIG. 5 is similar to that of FIG. 4. Therefore, for the sake of brevity, only the differences between the sequence of FIG. 4 and the sequence of FIG. 5 are described. The system of FIG. 10 may provide the sequence shown in FIG. 5.

Cylinder events of a six cylinder engine are out of phase by 120 crankshaft degrees. For example, the intake stroke of cylinder number one occurs 120 crankshaft degrees before the intake stroke of cylinder number four. Therefore, to assist the closing of an exhaust valve of one cylinder of the six cylinder engine, the tappet of an intake valve of a cylinder one event ahead in the combustion order of the engine is put in hydraulic communication with the exhaust valve tappet.

The exhaust stroke of cylinder number two is the first complete exhaust stroke shown in FIG. 5. The exhaust valve tappet of cylinder number two is in hydraulic communication with the intake valve tappet of cylinder number four. Cylinder number four is 120 crankshaft degrees ahead of cylinder number two. Similarly, the intake valve tappet of cylinder number one is in hydraulic communication with the exhaust valve tappet of cylinder number four. Further, the intake valve tappet of cylinder number six is in hydraulic communication with the exhaust valve tappet of cylinder number one. Further still, the intake valve tappet of cylinder number two is in hydraulic communication with the exhaust valve tappet of cylinder number five. In addition, the intake valve tappet of cylinder number five is in hydraulic communication with the exhaust valve tappet of cylinder number three.

When an intake valve tappet is put in hydraulic communication with an exhaust valve tappet, it allows the intake valve camshaft to assist in the opening of the exhaust valve of another cylinder. For example, the exhaust valve of cylinder number two is open during exhaust stroke 508. The intake valve of cylinder number four opens during exhaust stroke 508, and oil pressure in the intake valve tappet of cylinder number four reaches a peak at 502. Oil from the intake valve tappet of cylinder number four is transferred to the exhaust valve tappet of cylinder number two during the time the exhaust valve of cylinder number two is closing. Consequently, the opening of the intake valve in cylinder number four assists in the closing of the exhaust valve of cylinder number two.

Cylinder number five exhaust stroke 514 begins 120 crankshaft degrees after the beginning of exhaust stroke 508. The pressure in the exhaust tappet of cylinder number five increases as the exhaust valve reaches peak lift. Since the intake valve tappet of cylinder number two is coupled to the exhaust valve tappet of cylinder number five, oil pressure in the intake valve tappet of cylinder two reaches a first pressure peak at 504. The pressure oil pressure peak at 504 occurs when there is a low lift amount for the intake valve of cylinder number two. Consequently, the oil pressure peak caused by opening the exhaust valve of cylinder number five can be overcome by the intake camshaft. The intake camshaft causes oil pressure in the intake valve tappet to increase and reach a peak at 506 where the oil pressure can help close the exhaust valve of cylinder number five. Similarly, the intake valve tappet oil pressure peaks at 510 and 512 result from opening the exhaust valve of cylinder number three and opening the intake valve of cylinder number five.

In this way, the opening of an intake valve of one cylinder can assist the exhaust valve closing of another cylinder. It should also be mentioned that intake valve closing may also be assisted via changing the order of hydraulically communication between engine cylinder tappets. Thus, in some examples, only closing of exhaust valves may be assisted. In other examples, only closing of intake valves may be assisted. Further, in some examples closing of both intake valves and exhaust valves may be assisted via hydraulically coupling tappet bores. In addition, the timing of when the intake valve of one cylinder assists the exhaust valve closing of another cylinder may be adjusted by retarding or advancing intake valve opening timing. Intake valve opening timing for six cylinder engines may be retarded to increase pressure in the exhaust valve tappet at exhaust valve closing timing.

Figure 6:
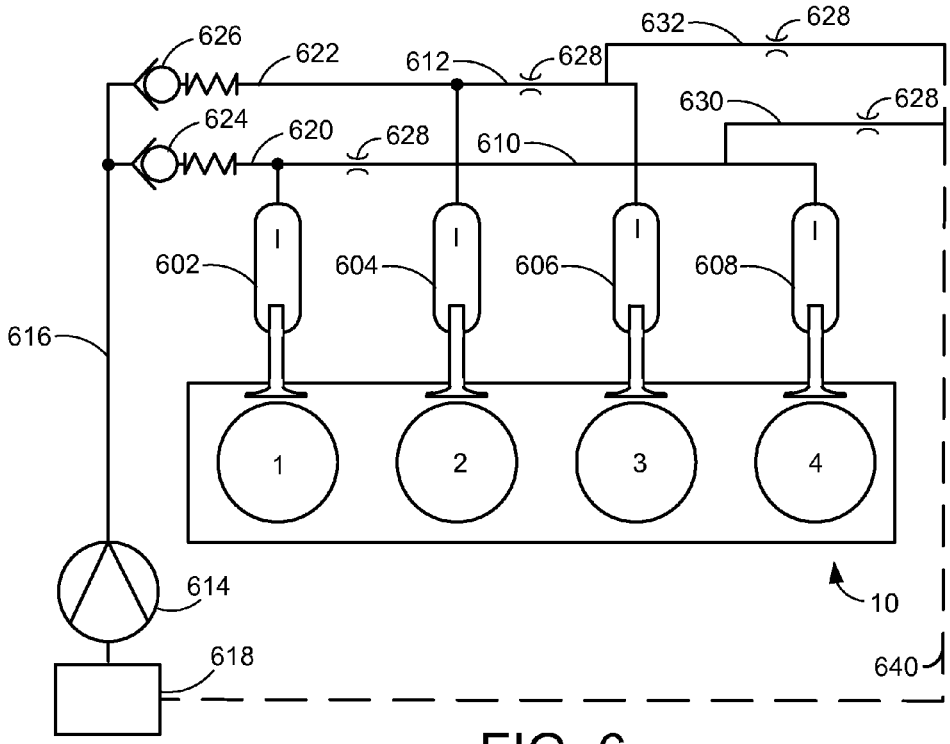
FIGS. 6-10 illustrate engine valve systems according to various examples of the present disclosure.

FIGS. 6-9 illustrate example engine valve systems. FIG. 6 illustrates hydraulic coupling of intake valve tappets of a four cylinder inline engine 10 according to a first example. Engine 10 has four cylinders, each of which includes an intake valve with tappet. Cylinder one includes an intake valve and tappet 602, cylinder two includes an intake valve and tappet 604, cylinder three includes an intake valve and tappet 606, and cylinder four includes an intake valve and tappet 608. As described with respect to FIG. 3A, tappets 602 and 608 are hydraulically connected by a bidirectional oil passage 610. Tappets 604 and 606 are hydraulically connected by a bidirectional oil passage 612. An oil pump 614 provides pressurized engine oil to the tappets via the main engine oil gallery 616. A sump 618 is hydraulically connected to the oil pump to provide an oil reservoir for the pump. The sump 618 may collect excess oil from the engine 10 during normal engine operation. The oil pump 614 may be configured to provide oil at a constant pressure. Alternatively, the pump may be a variable pressure oil pump, configured to provide oil at different pressures depending on engine operating conditions. In the system of FIG. 6, oil feed passages 620, 622 may split off from the main oil gallery to provide oil to each bidirectional oil passage 610, 612. Check valves 624, 626 may be provided within passages 620, 622 to allow oil to flow into the bidirectional oil passages 610, 612 when pressure in the tappets and bidirectional oil passage drops below a predetermined threshold. The check valves 624, 626 also prevent oil backflow to the oil pump. The bidirectional oil passages 610, 612 may also contain orifices 628 to bleed excess engine oil back to the sump if pressure in the passages becomes too high. These orifices may be configured to regulate the pressure in the bidirectional oil passages, and thus regulate the closing forces provided to the valves. The engine valve system may optionally include orifice tubes 630, 632 coupled to the bidirectional oil passages 610, 612 to bleed excess oil back to the sump 618 via oil passage 640.

In the system of FIG. 6, oil from cylinder number one intake valve tappet is transferred to cylinder number four intake valve tappet. Likewise, oil from cylinder number four intake valve is transferred to cylinder number one intake valve tappet. Intake valve tappets for cylinders two and three are also shown in hydraulic communication so that oil can be exchanged between the intake valve tappets.

Figure 7:
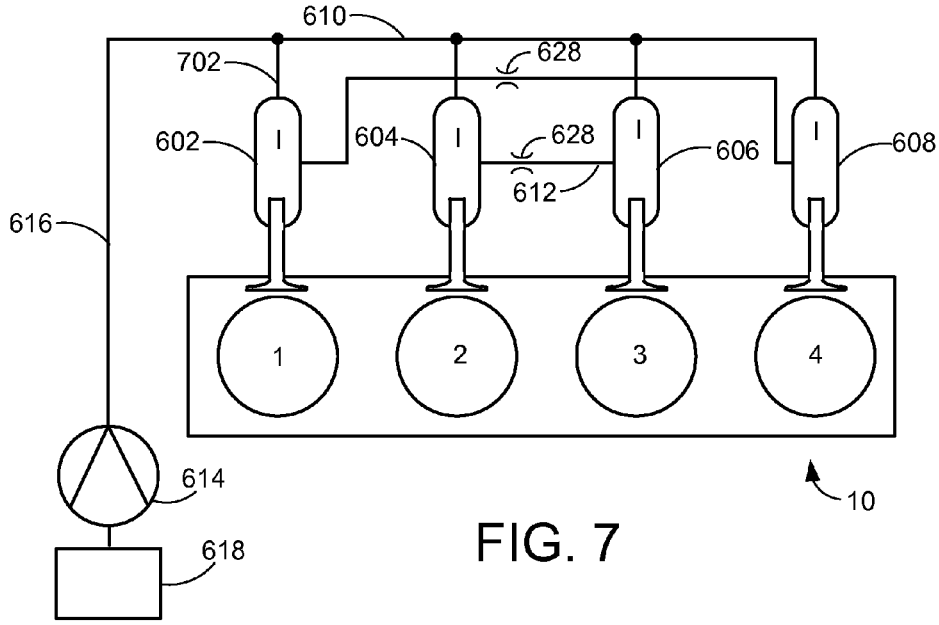

FIG. 7 illustrates the engine valve system according to a different example of the present disclosure. Similar to the valve system explained above with respect to FIG. 6, tappets 602 and 608 are connected by a bidirectional oil passage 610, and tappets 604 and 606 are hydraulically connected by a bidirectional oil passage 612. An oil pump 614 may pump oil from sump 618 to the tappets via the oil gallery 616. In the example depicted in FIG. 7, each tappet may be configured to receive pressurized engine oil from pump 614. Oil feed passages, for example feed passage 702, may provide oil to each tappet from the oil gallery 616.

It should be understood that although intake valves are depicted in FIGS. 6 and 7, the same configurations may be applied to the exhaust cylinders of engine 10. Additionally, one intake valve per cylinder is depicted in FIGS. 6 and 7, however, each cylinder may have more than one intake valve. If each cylinder has more than one intake valve, both tappets for both intake valves per cylinder may be connected with the same bidirectional oil passage. Alternatively, a tappet of a first intake valve of a first cylinder may be connected to a tappet of a first intake valve of a different cylinder via one bidirectional oil passage, while a tappet of a second intake valve of the first cylinder may be connected to a tappet of a second valve of the different cylinder via a second bidirectional oil passage.

Figure 8:
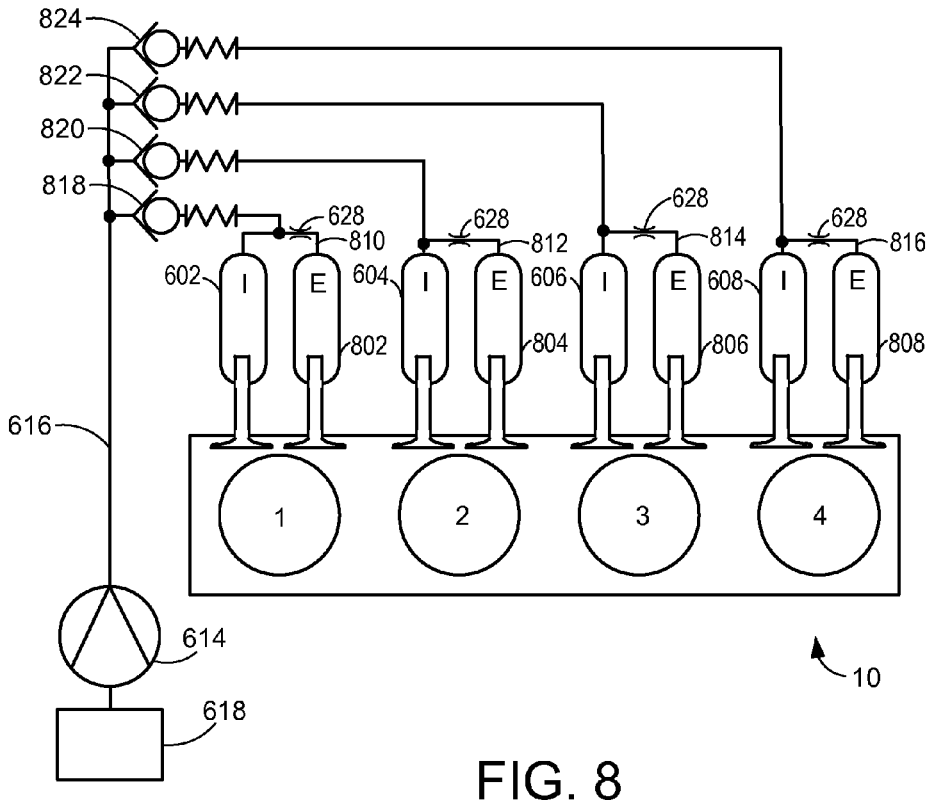

Turning to FIG. 8, an engine valve system according to an additional example of the disclosure is depicted. The valve system illustrated in FIG. 8 is configured to hydraulically couple the timing of the intake valves with the timing of the exhaust valves. In addition to the intake valves and associated tappets described with respect to FIGS. 6 and 7, FIG. 8 additionally depicts exhaust valves and associated tappets. Cylinder one includes an intake valve and tappet 602 and exhaust valve and tappet 802, cylinder two includes an intake valve and tappet 604 and exhaust valve and tappet 804, cylinder three includes an intake valve and tappet 606 and exhaust valve and tappet 806, and cylinder four includes an intake valve and tappet 608 and exhaust valve and tappet 808. Intake valve tappet 602 is connected to exhaust valve tappet 802 via bidirectional oil passage 810. Exhaust valve tappet 804 is connected to intake valve tappet 604 via bidirectional oil passage 812, intake valve tappet 606 is connected to exhaust valve tappet 806 via bidirectional oil passage 814, and exhaust valve tappet 808 is connected to intake valve tappet 608 via bidirectional oil passage 816. An oil pump 614 pumps oil from sump 618 to the bidirectional oil passages via oil gallery 616. Similar to the system described with respect to FIG. 6, check valves 818, 820, 822, 824 are positioned between the oil gallery and each bidirectional oil passage to provide a unidirectional oil flow to maintain oil pressure in the tappets and oil passages. Further control of the oil pressure is provided by orifices 628 in the bidirectional oil passages.

FIG. 9 illustrates the engine valve system according to another example. Similar to the system illustrated in FIG. 8, each intake valve tappet is in hydraulic communication with an exhaust valve and tappet. In the system of FIG. 9, similar to the system described with respect to FIG. 7, the oil is pumped from the sump 618 by the oil pump 614 through the oil gallery 616 to each individual intake and exhaust tappet through individual feed passages, for example passage 902.

The systems of FIGS. 8 and 9 may provide the oil pressures illustrated in FIG. 4. Further, the timing of intake and/or exhaust valves with respect to the engine crankshaft may be adjusted so that the amount of valve closing assistance may be adjusted. In some examples, the engine camshafts may be adjusted based on engine speed to vary the closing force supplied to assist the closing of valves.

Figure 10:
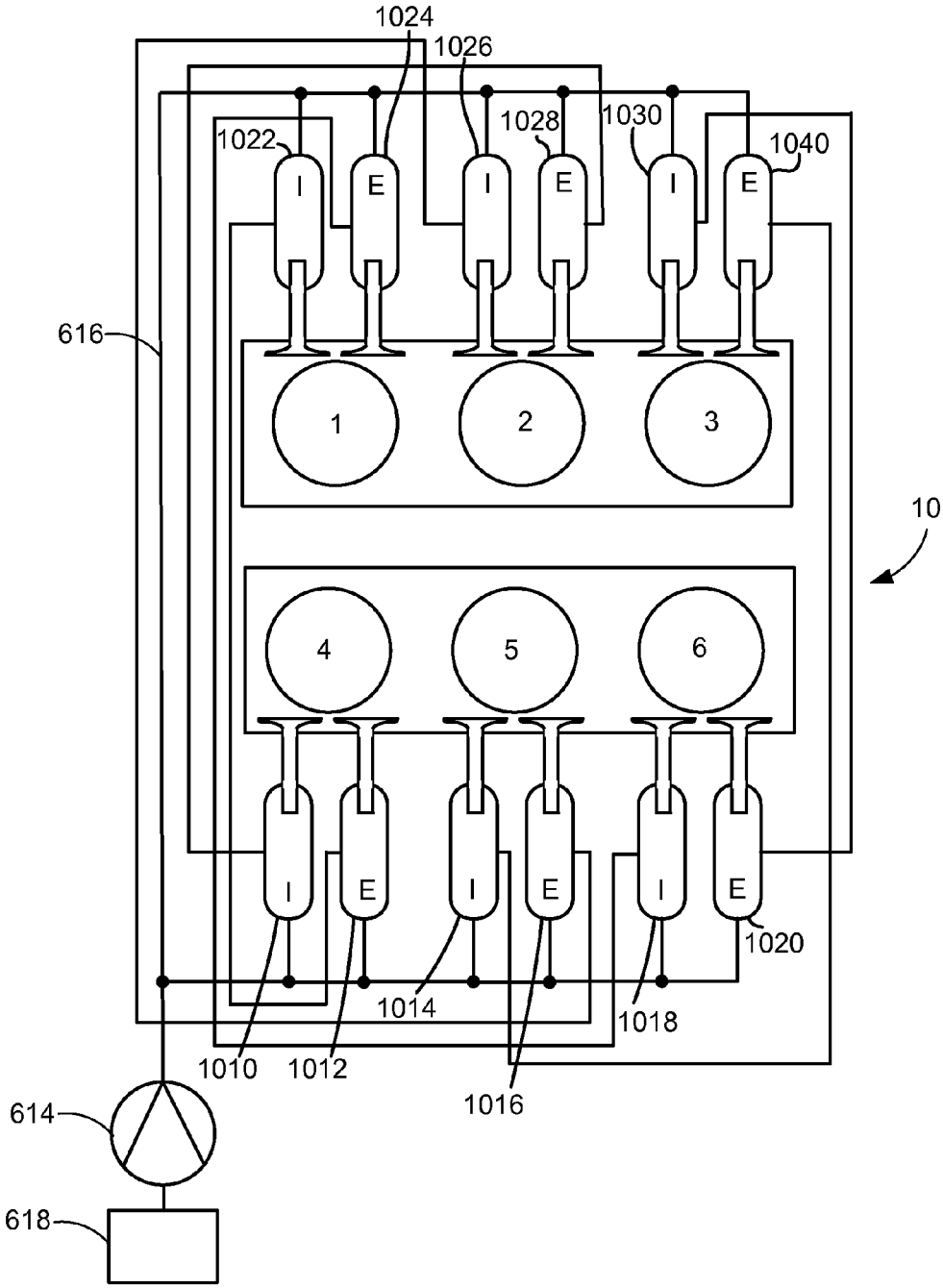

Referring now to FIG. 10, an example six cylinder engine with hydraulically assisted valve closing is shown. All six engine cylinders are shown with intake and exhaust valve tappets. Intake valve tappet 1022 of cylinder number one is shown in hydraulic communication with exhaust valve tappet 1012 of cylinder number four. Intake valve tappet 1026 of cylinder number two is shown in hydraulic communication with exhaust valve tappet 1016 of cylinder number five. Intake valve tappet 1030 of cylinder number three is shown in hydraulic communication with exhaust valve tappet 1020 of cylinder number six. Intake valve tappet 1010 of cylinder number four is shown in hydraulic communication with exhaust valve tappet 1028 of cylinder number two. Intake valve tappet 1014 of cylinder number five is shown in hydraulic communication with exhaust valve tappet 1040 of cylinder number three. Intake valve tappet 1018 of cylinder number six is shown in hydraulic communication with exhaust valve tappet 1024 of cylinder number one.

In this way, the intake valve tappets of one cylinder may be in hydraulic communication with exhaust valve tappets of another cylinder to assist in exhaust valve closing. Further, timing of assisting of intake or exhaust valves may be adjusted via variable camshaft timing devices.

Thus, the systems of FIGS. 1-10 provide for a valve system for an engine, comprising a first tappet bore of a first cylinder and a second tappet bore of a second cylinder, and a bidirectional oil passage in fluid communication with the first tappet bore and the second tappet bore. The system also includes an engine oil gallery in fluid communication with the bidirectional oil passage, the engine oil gallery fed oil by an oil pump. The system further includes first and second tappets positioned within the first and second tappet bores, the first and second tappets including oil bleed holes at faces of the first and second tappets. The system also includes a check valve located along the engine oil gallery, the check valve permitting oil flow from the oil gallery to the bidirectional oil passage, and the check valve substantially preventing oil flow from the bidirectional oil passage to the oil gallery. The system applies where the bidirectional oil passage solely fluidly couples the first tappet bore to the second tappet bore. The system further applies where the first and second cylinders are 180 crankshaft degrees apart in a firing order of the engine. The system also includes a flow limiting orifice positioned in the bidirectional oil passage. The system further applies where a bottom of the first tappet and a bottom of the first tappet bore provide a first oil reservoir, and where a bottom of the second tappet and a bottom of the second tappet bore provide a second oil reservoir.

The systems of FIGS. 1-10 also provide for an internal combustion engine, comprising a first tappet bore of a first cylinder and a second tappet bore of a second cylinder, a first unidirectional oil passage in fluid communication with the first tappet bore and the second tappet bore, and a second unidirectional oil passage in fluid communication with the first tappet bore and the second tappet bore, a flow direction of the first unidirectional oil passage opposite a flow direction of the second unidirectional oil passage. The system applies where the first tappet bore includes a tappet activating an intake valve and where the second tappet bore included a tappet activating an intake valve. The system also applies where the first tappet bore includes a tappet activating an intake valve and where the second tappet bore included a tappet activating an exhaust valve. The system includes a first tappet in the first tappet bore and a second tappet in the second tappet bore, the first tappet and the first tappet bore including first and second valves, the first valve restricting flow through the first unidirectional oil passage when the first tapped is in a first position, the second valve restricting flow through the second unidirectional oil passage when the first tappet is in a second position. The system further includes a first tappet in the first tappet bore and a second tappet in the second tappet bore, the second tappet and the second tappet bore including first and second valves, the first valve restricting flow through the first unidirectional oil passage when the second tappet is in a first position, the second valve restricting flow through the second unidirectional oil passage when the second tappet is in a second position.

Figure 11:
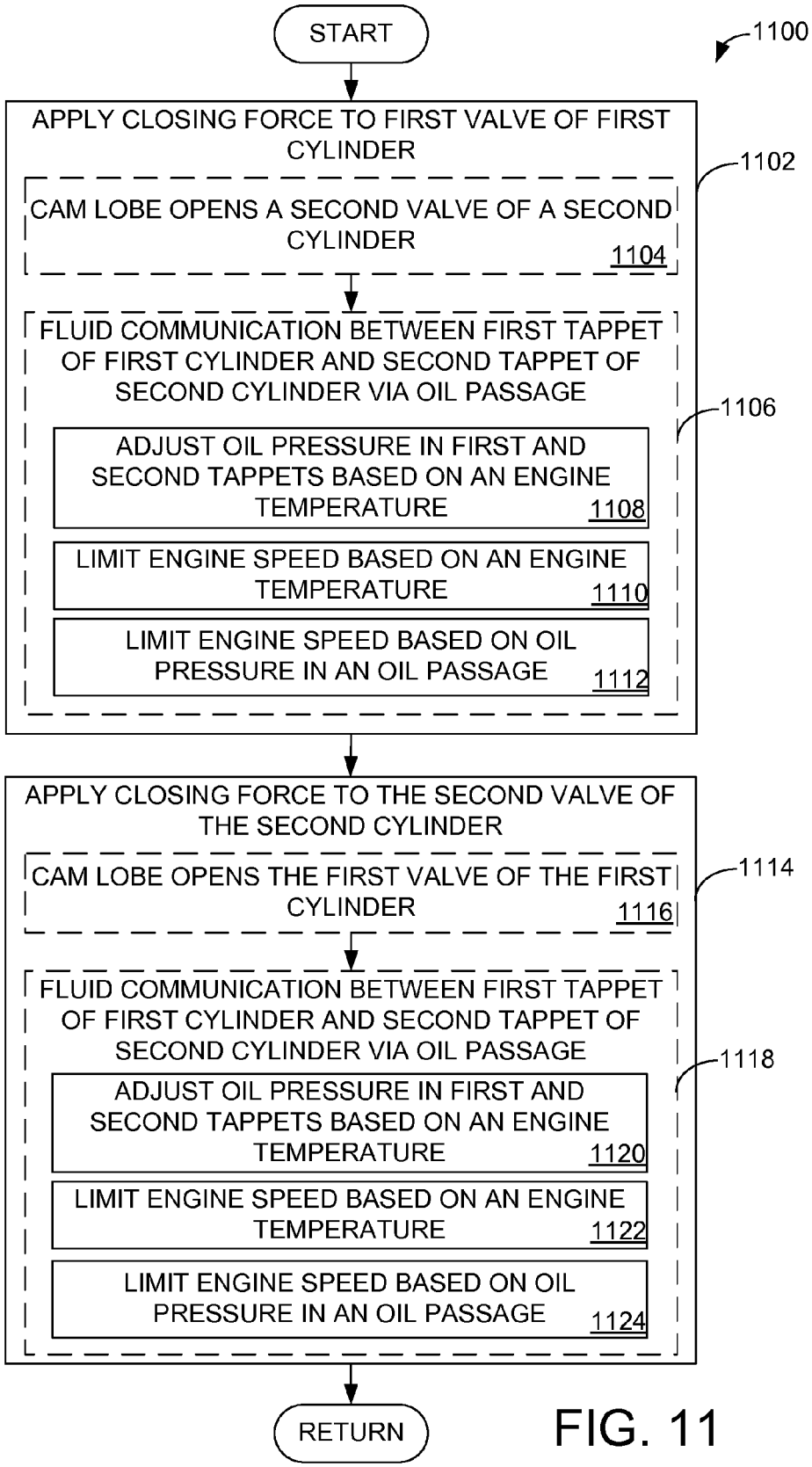
FIG. 11 is a flow chart depicting an example method for providing valve closing force.

Turning to FIG. 11, a flow chart illustrates an example method 1100 for providing valve closing forces. At 1102, method 1100 comprises applying closing force to a first valve of a first cylinder. The first valve may be an intake valve, or may be an exhaust valve. At 1104, method 1100 opens a second valve of a second cylinder via a camshaft lobe. In other examples, the intake valve and the exhaust valves may be in the same cylinder. The second valve may be an intake or an exhaust valve. Fluid communication may occur between a first tappet of the first cylinder and a second tappet of the second cylinder via an oil passage at 1106. The oil passage may be a bidirectional oil passage configured to allow free oil flow between the first and second tappets. Alternatively, the oil passage may be a unidirectional oil passage configured to allow oil to flow from the second tappet to the first tappet and restrict oil flow from the first tappet to the second tappet. At 1108, oil pressure in the first and second tappets may be adjusted based on an engine temperature. For example, engine controller 12 may determine engine temperature based on coolant temperature, or may estimate engine temperature based on time or number of cylinder events since engine start. Because oil viscosity increases at lower engine temperatures, low engine temperatures may cause increased oil pressure. Engine controller 12 may control oil pump 614 to adjust the pressure of oil provided to the first and second tappets to maintain a desired level of oil pressure for providing the closing force to the first valve. At 1110, engine speed may be limited based on an engine temperature so that hydraulic communication between tappets is taken into account. For example, engine controller 12 may determine engine temperature based on coolant or oil temperature, or may estimate engine temperature based on time or number of cylinder events since engine start. If the engine controller 12 determines engine temperature is high, oil pressure in the first and second tappets may be too low to provide desired closing force to the first valve. Engine speed may be limited by engine controller 12 by adjusting fuel injection, throttle, and/or spark timing, for example, to achieve lower RPM and therefore lowered required valve closing force. At 1112, engine speed may be limited based on oil pressure in an oil passage. Engine controller 12 may determine oil pressure in an oil passage, for example in a bidirectional oil passage, and limit engine speed if the determined oil pressure in the oil passage is low. Engine speed may be limited by engine controller 12 by adjusting fuel injection, throttle, and/or spark timing, for example, to achieve low RPM and therefore lowered required valve closing force.

At 1114, method 1100 comprises applying closing force to the second valve of the second cylinder. A camshaft lobe opens the first valve of the first cylinder at 1116. Fluid communication occurs between the first tappet of the first cylinder and the second tappet of the second cylinder via an oil passage at 1118. The oil passage may be a bidirectional oil passage configured to allow free oil flow between the first and second tappets. Alternatively, the oil passage may be a unidirectional oil passage configured to allow oil to flow from the first tappet to the second tappet and restrict oil flow from the second tappet to the first tappet. At 1120, oil pressure in the first and second tappets may be adjusted based on an engine temperature. For example, engine controller 12 may determine engine temperature based on coolant temperature, or may estimate engine temperature based on time or number of cylinder events since engine start. Because oil viscosity increases at lower engine temperatures, low engine temperatures may cause increased oil pressure. Engine controller 12 may control oil pump 614 to adjust the pressure of oil provided to the first and second tappets to maintain a desired level of oil pressure for providing the closing force to the second valve. At 1122, engine speed may be limited based on an engine temperature. For example, engine controller 12 may determine engine temperature based on coolant or oil temperature, or may estimate engine temperature based on time or number of cylinder events since engine start. If the engine controller 12 determines engine temperature is high, oil pressure in the first and second tappets may be too low to provide desired closing force to the second valve. Engine speed may be limited by engine controller 12 by adjusting fuel injection, throttle, and/or spark timing, for example, to achieve low RPM and therefore lowered required valve closing force. At 1124, engine speed may be limited based on oil pressure in an oil passage. Engine controller 12 may determine oil pressure in an oil passage, for example in a bidirectional oil passage or in a main engine oil gallery, and limit engine speed if the determined oil pressure in the oil passage is low. Engine speed may be limited by engine controller 12 by adjusting fuel injection, throttle, and/or spark timing, for example, to achieve low RPM and therefore lowered required valve closing force.

Thus, the method of FIG. 11 provides for a method for controlling valve operation, comprising pumping oil from a first tappet of a first cylinder to a second tappet of a second cylinder without returning the oil to an oil sump, and pumping the oil from the second tappet of the second cylinder to the first tappet of the first cylinder without returning the oil to the oil sump. The method applies where the oil is pumped through a single bidirectional oil passage. The method further applies where the oil is pumped through a first unidirectional oil passage in a first direction, and where the oil is pumped though a second unidirectional oil passage in a second direction, the second direction different than the first direction. The method also applies where the oil is pumped via force provided via a camshaft. The method includes limiting oil pressure in the first and second tappet based on engine temperature. The method also includes limiting engine speed based on an engine temperature when pumping oil from a first tappet of a first cylinder to a second tappet of a second cylinder without returning the oil to an oil sump. The method further includes limiting engine speed based on a pressure of the oil when pumping oil from a first tappet of a first cylinder to a second tappet of a second cylinder without returning the oil to an oil sump.

The method of FIG. 11 also provides for a method for controlling valve operation, comprising applying a closing force to a first valve of a first cylinder via fluid communication between a first tappet of the first cylinder and a second tappet of a second cylinder, and applying a closing force to a second valve of the second cylinder via fluid communication between the second tappet of the second cylinder and the first tappet of the first cylinder. The method applies where applying the closing force to the first valve is via a bidirectional oil passage. The method includes adjusting a pressure of engine oil in the bidirectional oil passage in response to engine speed to adjust dampening of the first valve. The method also applies where the closing force to the first valve is initiated via a cam lobe opening a valve of the second cylinder, and where the first and second cylinders are a multiple of 180 crankshaft degrees apart in an engine combustion order. The method further applies where applying the closing force to the first valve is via a unidirectional oil passage between a first tappet bore housing the first tappet and a second tappet bore housing the second tappet.

The method of FIG. 11 also provides for a method for controlling valve operation, comprising pumping oil from a first tappet of a first cylinder to a second tappet of a second cylinder via a bidirectional oil passage, and pumping oil from the second tappet of the second cylinder to the first tappet of the first cylinder via the bidirectional oil passage. The method applies where pumping oil from the first tappet of the first cylinder to the second tappet of the second cylinder is provided via rotating a camshaft.

As will be appreciated by one of ordinary skill in the art, the method described in FIG. 11 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for controlling valve operation, comprising:

applying a closing force to a first valve of a first cylinder via a first tappet of the first cylinder fluidly communicating with a second tappet of a second cylinder;

applying a closing force to a second valve of the second cylinder via the second tappet of the second cylinder fluidly communicating with the first tappet of the first cylinder; and limiting engine speed based on engine temperature.

2. The method of claim 1, where applying the closing force to the first and second valves is via a bidirectional oil passage.

3. The method of claim 2, wherein applying a closing force to one of the first and second valves further comprises adjusting a pressure of engine oil in the bidirectional oil passage in response to engine speed to adjust dampening of that valve.

4. The method of claim 1, where the closing force to one of the first and second valves is initiated via a cam lobe opening the other of the first and second valves and where the first and second cylinders are a multiple of 90 crankshaft degrees apart in an engine combustion order.

5. The method of claim 1, where applying the closing force to the first valve is via a first unidirectional oil passage connecting a first tappet bore housing the first tappet and a second tappet bore housing the second tappet, wherein applying the closing force to the second valve is via a second unidirectional oil passage connecting the first tappet bore and the second tappet bore, and wherein a direction of oil flow in the second unidirectional oil passage is opposite to a direction of oil flow in the first unidirectional oil passage.

6. The method of claim 1, wherein applying a closing force further comprises adjusting oil pressure in the first and second tappets based on engine temperature.

7. A method for controlling valve operation, comprising:

applying a closing force to a first valve of a first cylinder via a first tappet of the first cylinder hydraulically communicating with a second tappet of a second cylinder;

applying a closing force to a second valve of the second cylinder via the second tappet hydraulically communicating with the first tappet; and limiting engine speed based on engine temperature, wherein the first and second tappets hydraulically communicate via a bidirectional passage.

8. The method of claim 7, wherein the first valve is an intake valve of the first cylinder and the second valve is an exhaust valve of the second cylinder.

9. The method of claim 8, wherein applying a closing force to the second valve further comprises transferring force from the first tappet to the second tappet via the bidirectional passage during an overlap period of the first and second valves.

10. The method of claim 9, wherein the first cylinder is one event ahead of the second cylinder in an engine combustion order.

11. The method of claim 7, wherein applying a closing force to one of the first and second valves further comprises adjusting a pressure of engine oil in the bidirectional oil passage in response to engine speed to adjust dampening of that valve.

12. The method of claim 7, where the closing force to one of the first and second valves is initiated via a cam lobe opening the other of the first and second valves, and where the first and second cylinders are a multiple of 90 crankshaft degrees apart in an engine combustion order.

13. The method of claim 7, wherein applying a closing force further comprises adjusting oil pressure in the first and second tappets based on engine temperature.

14. A method for controlling valve operation, comprising:

applying a closing force to a first valve of a first cylinder via a first unidirectional oil passage fluidly coupling a first tappet bore of the first cylinder with a second tappet bore of a second cylinder; and applying a closing force to a second valve of the second cylinder via a second unidirectional oil passage fluidly coupling the second tappet bore with the first tappet bore.

15. The method of claim 14, wherein oil is pumped through the first unidirectional oil passage in a first direction, wherein oil is pumped though the second unidirectional oil passage in a second direction, and wherein the second direction is different than the first direction.

16. The method of claim 14, where the closing force to one of the first and second valves is initiated via a cam lobe opening the other of the first and second valves, and where the first and second cylinders are a multiple of 90 crankshaft degrees apart in an engine combustion order.

17. The method of claim 14, wherein applying a closing force further comprises adjusting oil pressure in the first and second tappet bores based on engine temperature.

18. The method of claim 14, further comprising limiting engine speed based on engine temperature.

* * * * *